United States Patent [19]

Dreier

[11] Patent Number: 4,465,006

[45] Date of Patent: Aug. 14, 1984

[54] THREAD GRIPPER AND CUTTING DEVICE FOR A SEWING MACHINE

[75] Inventor: Ernst Dreier, Steckborn, Switzerland

[73] Assignee: Fritz Gegauf Aktiengesellschaft Bernina-Nähmaschinenfabrik, Steckborn, Switzerland

[21] Appl. No.: 454,620

[22] Filed: Dec. 30, 1982

[30] Foreign Application Priority Data

Jan. 19, 1982 [CH] Switzerland ..... 305/82
Jul. 5, 1982 [CH] Switzerland ..... 4083/82

[51] Int. Cl.[3] ..... D05B 65/00
[52] U.S. Cl. ..... 112/292
[58] Field of Search ..... 112/285, 288, 291, 292; 30/124, 134, 135; 83/916, 588, 917

[56] References Cited

U.S. PATENT DOCUMENTS 4,181,088 1/1980 Kessler et al. ..... 112/292
4,254,725 3/1981 Hager et al. ..... 112/292

FOREIGN PATENT DOCUMENTS 7405640 5/1974 Fed. Rep. of Germany .
633335 11/1982 Switzerland ..... 112/285

*Primary Examiner*—Werner H. Schroeder
*Assistant Examiner*—Andrew M. Falik
*Attorney, Agent, or Firm*—Birch, Stewart, Kolasch and Birch

[57] ABSTRACT

A thread gripper and cutting device for a sewing machine is inserted in a cover plate (1) forming the working surface (A) of the sewing machine. Thus the thread gripper and cutting device is inserted in one of the corner points of the diagonal of an imagining square (y), with the point of needle penetration (x) lying in the other corner point thereof. A first clamping disk (8) is integrally joined via a marginal web (4c) with the shank portion (4a) of a retaining bush (4). The clamping disk (8), which is rounded on all sides, projects only a little beyond the working surface (A) and is slightly inclined with respect to the latter. The corresponding end face (12) of a second clamping disk (11) is urged, by means of a spring (14), against the inner face (9) of the clamping disk (8). This second clamping disk is seated on a pin (13) guided in the shank portion (4a). The lead-in slot (15) for the threads (F) lies at the highest point of the clamping plane formed by the clamping surfaces (9, 12). The line of slope of this clamping plane is located approximately at a right angle to the aforementioned diagonal (x-b). The edge of the marginal web (4c) most removed from the penetration point (x) and lying on an outer surface line of the retaining bush (4) is formed directly below the first clamping disk (8) as a cutting blade (10). The marginal web (4c) is crescent-shaped in cross section.

12 Claims, 9 Drawing Figures

A
21
21a
21b
21c
21d
24
24a
24b
24c
28
30
31
33
34
35
36
37
38
38a
38b
39
40
41
41a
41b
42
42a
43
VII

THREAD GRIPPER AND CUTTING DEVICE FOR A SEWING MACHINE

BACKGROUND AND SUMMARY OF THE INVENTION

The present invention relates to a thread gripper and cutting device arranged at a sewing machine and comprising two resiliently cooperating clamping disks and a cutter with a cutting edge arranged at an angle to the clamping plane of the disks. A thread gripper and cutting device of this type is known, for example, from German Utility Model No. 7,405,640. In this disclosure, a first clamping disk, which projects only to a slight extent, is fixed in a recess of the machine. The second clamping disk, lying thereabove and thus projecting to a great extent, is urged against the first clamping disk by means of a spring. This second clamping disk is provided on a guide pin axially penetrating the first, fixed clamping disk. The cutter, disposed in a recess of the first clamping disk, projects with its cutting blade past the clamping plane of the clamping surface of the first clamping disk so that, when the thread is introduced in between the two disks (which means a positive lifting off of the second disk from the clamping surface of the first disk), the thread can enter into the zone of the cutting blade. In any event, a clamping and cutting device of this type thus projects considerably past the wall surface of the machine at the installation point. Consequently, it is inherently impossible to mount this device in the region of the working surface of the machine, i.e. where it would be ideally needed for severing the top and bottom threads after a sewing operation and for gripping the thread ends before the subsequent sewing step.

In contrast thereto, the present invention has the object of providing a gripper and cutting device of the aforementioned type which can be installed at the location most logical for its use, i.e. in the working surface of the machine, without impeding the sewing operation, i.e. the flow of sewing material along the working surface, and which is also at an optimum with respect to the gripping and cutting effects. For this purpose, the gripper and cutting device of the present invention is characterized by a retaining bush inserted at a spacing from the point of needle penetration in a recess of the working surface of the machine and secured against rotation. The inner shank portion of the retaining bush is integrally joined, via an axially parallel marginal web equipped with the cutter blade, with an end portion constituting the outer clamping disk and projecting, in the operative position, at least partially and, in the inoperative position, at most partially beyond the working surface. On the other hand, the inner clamping disk, which is guided in an axially movable fashion between the shank portion and the end portion along the marginal web, is urged, by means of a spring resting on the shank portion, with its outwardly oriented clamping surface, against the inwardly oriented clamping surface of the first clamping disk.

Because of this type of construction, it is possible to arrange the clamping plane, which is constituted by the contact surfaces of the two clamping disks either directly, namely only to a minor extent, above the working surface, or, in the idle position, where the plane is lowered below the working surface. Since the inner clamping disk is moved further inwardly by the inserted threads while the outer clamping disk is stationary, and also because the cutter edge terminates at this fixed disk, at most the outer clamping disk, the thickness of which is determined only by strength considerations, needs to project, in the inoperative position, beyond the working surface of the machine. In order to avoid, at least temporarily, even this slight projection of parts of the device in certain working processes, the retaining bush is suitably lowerable against the bias of a spring, by slight pressure, from the operating position of the device entirely into or below the working surface of the machine. Advantageously, the outer end of the cutter blade and thus the corresponding part of the clamping plane, determined by the contact surface of the outer clamping disk, which contact surface is advantageously slightly inclined to the working surface, lie in the plane of the working surface, while the lead-in gap between the contact surfaces of the two clamping disks is disposed at a somewhat higher level.

In case of a free-arm sewing machine, the slight projection of the end portion past the working surface in the operative position is adequate for the introduction of the thread, since the latter, after all, is pulled downwardly over the arm edge and thus can be securely guided into position between the clamping disks while lying in close contact with the working surface. In the case of flat-bed sewing machines and industrial sewing machines, such a take-off edge is not available, so that it is often difficult to hold the thread so closely above the working surface that it will pass with certainty below the slightly projecting outer clamping disk. However, on the other hand, a more pronounced, permanent projecting of the upper clamping disk would positively impede, when working with such machines, the free movement of the sewing material on the working surface. The invention makes it possible to avoid this disadvantage by providing that a dog (entrainment means) movable by an operating element, engages the retaining bush, which in turn is axially displaceable in a guide bushing. This dog can be moved from a first operating position wherein the outer clamping disk is aligned with the working surface into a second operating position wherein the clamping plane formed between the clamping disks lies at a predetermined distance above the working surface.

Suitably, the dog is, for example, a double lever engaging with one arm, through a slot in the guide bushing and in the retaining bush. The double lever is pivotable within limits about an axis in parallel to the working surface. Actually, manual operation of the dog could effect this movement of placing the clamping disks into and out of an operative position with each other. On the other hand, it so happens that the gripper and cutting device is utilized practically only with the presser foot in the lifted position. Therefore, it has proven to be especially advantageous to connect the dog with the operating element of the lifting mechanism for the presser foot in such a way that automatically, but with a delay, the retaining bush can be shifted, together with the lifting of the presser foot, by the dog toward the outside to such an extent that the clamping plane between the two clamping disks lies sufficiently far above the working surface to make the perfect introduction of the thread possible. During the lowering of the presser foot, in a likewise automatic and accelerated fashion, the retaining bush is shifted inwardly to such an extent that the suitably planar outside of the outer clamping disk comes to lie in the plane of the working surface. In many sewing machines, the lifting mechanism for the presser foot is operable via a manual lever or a knee lever. In this case, it is also possible to operatively connect the dog, by way of a suitable linkage, to this manual or knee lever. Of course, electrical or electromagnetic couplings are likewise possible.

An arrangement has proven to be especially advantageous wherein the axis of the device is located in one diagonal corner point and the needle penetration point of the machine lies in the other diagonal corner point of a square, parallel-sided with respect to the feeding (advancing) axis, imagined to be located in the feeding direction of the sewing material behind and to the left of the point of needle penetration. The cutter blade lies, in this arrangement, on the outside corner surface line, farther removed from the point of needle penetration, of the connecting web between the outer clamping disk and the shank portion of the retaining bush, this connecting web having a segment or crescent shape in cross section.

This facilitates handling of the device during introduction, gripping, and cutting of the threads and ensures a sufficiently large thread length for both sewing threads necessary for the flawless resumption of sewing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
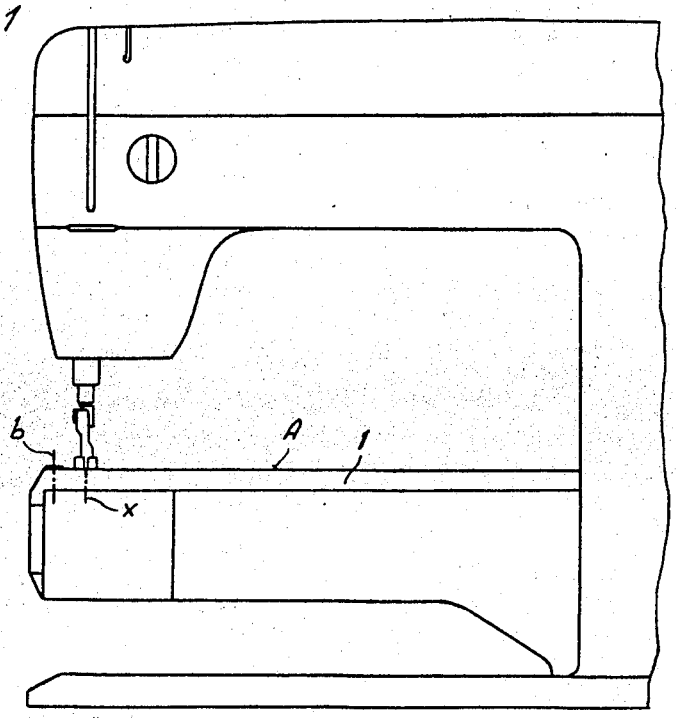
FIG. 1 is a frontal view of the sewing section of a free-arm sewing machine.
Figure 2:
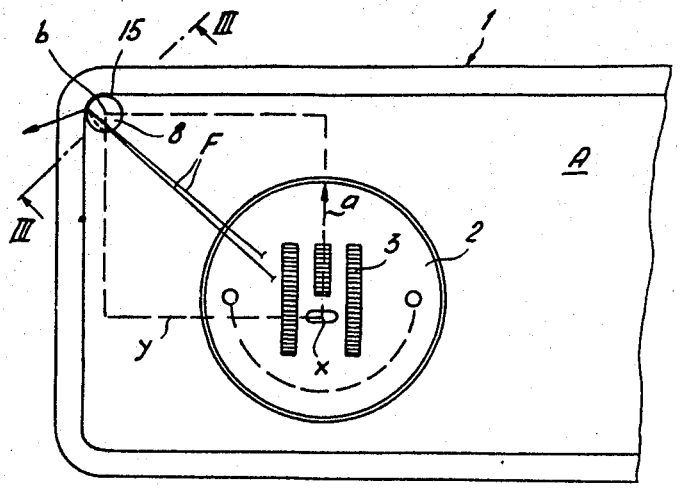
FIG. 2 shows, on an enlarged scale, a top view of the working surface of the free arm of the machine according to FIG. 1.

In the free-arm sewing machine shown in FIGS. 1 and 2, the free-arm cover plate constituting the working surface A is designated by element 1; the needle plate exhibiting the point of needle penetration x is designated by element 2; the feed dog acting through slots in this plate is designated by element 3, and the feeding direction of this feed dog is designated by a. Imagining a square y (FIG. 2) which is parallel-sided with respect to the marginal edges of the cover plate 1, one corner of this square is located at the point of needle penetration x. The square proper extends in the feeding direction a and to the left of the feeding axis, extending through the penetration point x. The axis b of the thread gripper and cutting device extends perpendicular to the cover plate 1, through the corner of the square y which is diagonally disposed with respect to the penetration point x.

Figure 3:
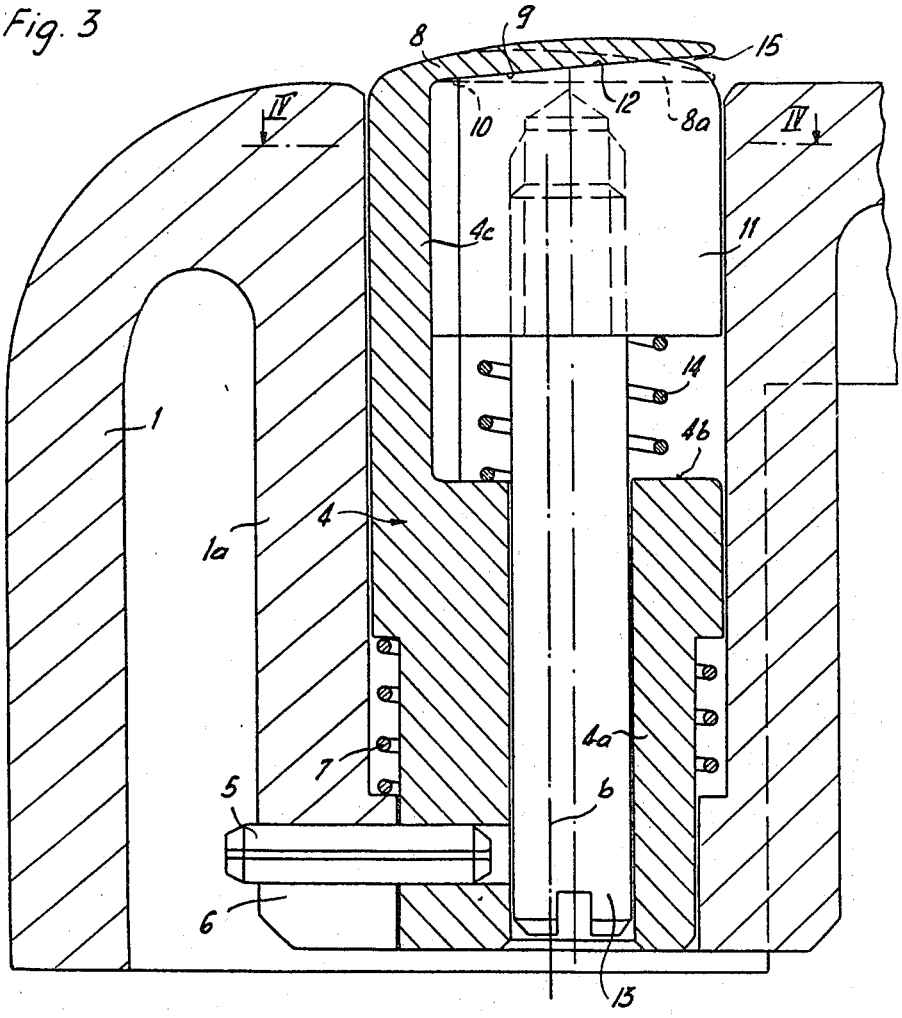
FIG. 3 shows, on an enlarged scale, an axial section taken along line III—III of FIG. 2 through the gripper and cutting device inserted in the cover plate of the free arm.

As shown in FIG. 3, a retaining bush 4 of the gripper and cutting device is inserted in the recess of an inwardly projecting cover eye plate 1*a*. The radial pin 5, fixed in place in an offset, and the inner shank portion 4*a* of the retaining bush 4, vertically guided in a wall slot 6 of the cover eye plate 1*a*, prevents the escape of the retaining bush 4 from the cover plate and also permits limited inward movement of the retaining bush 4 against the bias of a spring 7. Above the shank portion 4*a*, the retaining bush 4 is provided with a segment-shaped recess 4*b* extending over more than 100° of a peripheral angle, so that there remains an axially parallel marginal web 4*c*, having a crescent shape, in cross section, and a relatively thin-walled end portion 8 in the region of the working surface A. This end portion 8 which, as indicated at 8*a* in FIG. 3 with dashed lines, extends originally coaxially to the shank portion 4*a*, with its inner surface 9 within the plane of the working surface A. The end portion 8 is bent open at an acute angle of only a few degrees, for example about 5°, the topside of this end portion being slightly curved and rounded along its periphery. This end portion 8, forming, by the marginal web 4*c*, an integral part of the shank portion 4*a* of the retaining bush 4, constitutes one clamping disk of the device. The arrangement of the retaining bush 4 in the cover eye plate 1*a* is such that the corner surface lines of the marginal web 4*c* lie, in horizontal projection, on a line approximately in parallel to the aforementioned diagonal (x-b) of the square y, i.e. the line of the slope of the inner surface 9 of the clamping disk constituted by the end portion 8, which surface is lightly inclined with respect to the working surface A, extends approximately at a right angle to this square diagonal. The part of the axially parallel edge 10 of the marginal web 4*c* which is more remote from the penetration point x, and which emanates from the end portion 8, is fashioned with an outer bevel 10*a* to form the cutting blade 10. In the segment-like recess 4*b* of the retaining bush 4, a second clamping disk is adapted to the inner surface 9 of the first-mentioned clamping disk constituted by the end portion 8. The clamping disk 11 is fixedly mounted on a pin 13 guided, slightly offset with respect to the axis b of the retaining bush 4, in the shank portion 4*a* of the retaining bush 4. The clamping disk 11 is urged against the end portion 8 by means of a spring 14 resting on the shank portion 4*a*. The two contact surfaces 9, 12 of the end portion 8 and of the clamping disk 11 form the clamping plane which leads away from the outer end of the marginal web 4*c* lying in the working surface plane and thus also away from the cutter blade 10, in a slighly outwardly inclined fashion, to a thread lead-in gap 15, provided at that location by a relatively strong rounding of the clamping disk 11.

Since this lead-in gap 15, thanks to the small inclination of the clamping plane, lies only a little above the working surface A, it is possible after completion of a sewing operation to lead the top and bottom threads in a maximally simple way approximately in the direction of the aforementioned square diagonal in the feeding direction a, behind and around the device. In this connection, the threads, as indicated at F in FIG. 2, are guided by slight tension at the introduction point 15 between the end portion 8 and the clamping disk 11 and are severed on the cutting blade 10. The clamping disk 11, yielding resiliently inwardly during this step, firmly grips the thread portions F coming from the sewing site, against the end portion 8. Under practical conditions, it is readily possible to select the diagonal distance x-b to be several centimeters, suitably about 5 cm, so that during the subsequent resumption of the sewing operation, a sufficiently large available length of both threads F is provided to prevent, even in the case of an unfavorable needle position, an escape of the top thread from the needle eye and a sliding back of the gripper thread underneath the needle plate 2 when sewing is resumed.

A substantial advantage of the aforedescribed gripper and cutting device resides not only in that the cutting edge is nowhere exposed, but also, in particular, in that the outer clamping disk constituted by the end portion 8, which is fixed even during the gripping and cutting operation, projects only partially beyond the working surface A, that is, only on the side facing away from the sewing site, so that the clamping plate cannot impede the flow of the sewing material. On the other hand, if this minor projection of the overall rounded end portion 8 were to have an interfering effect, for example when using auxiliary means resting on the working surface A, such as an embroidery and darning frame, then the retaining bush 4 can be temporarily lowered completely into the operating surface A by pressing on the end portion 8 by means of such auxiliary devices, against the action of the spring 7. If desired, the gripper and cutting device can be locked in the hidden position by simple means, for example by a two-step design of a slot 6 and a minor radial twisting of the retaining bush 4.

Figure 4:
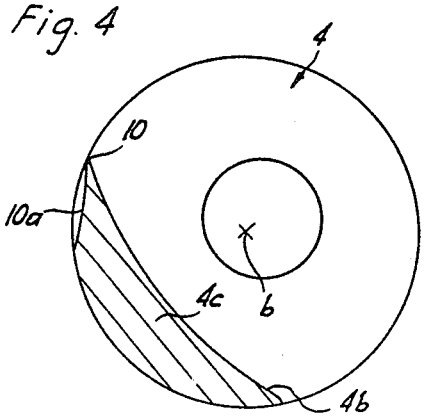
FIG. 4 shows a cross section of the retaining bush of the device taken along line IV—IV of FIG. 3.
Figure 5:
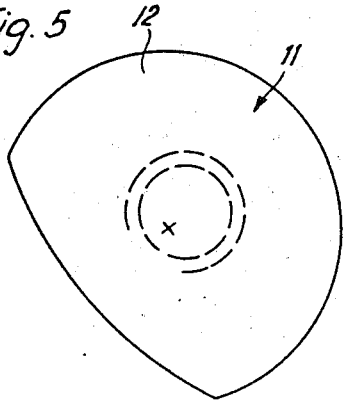
FIG. 5 shows a top view of the movable clamping disk of the device.
Figure 9:
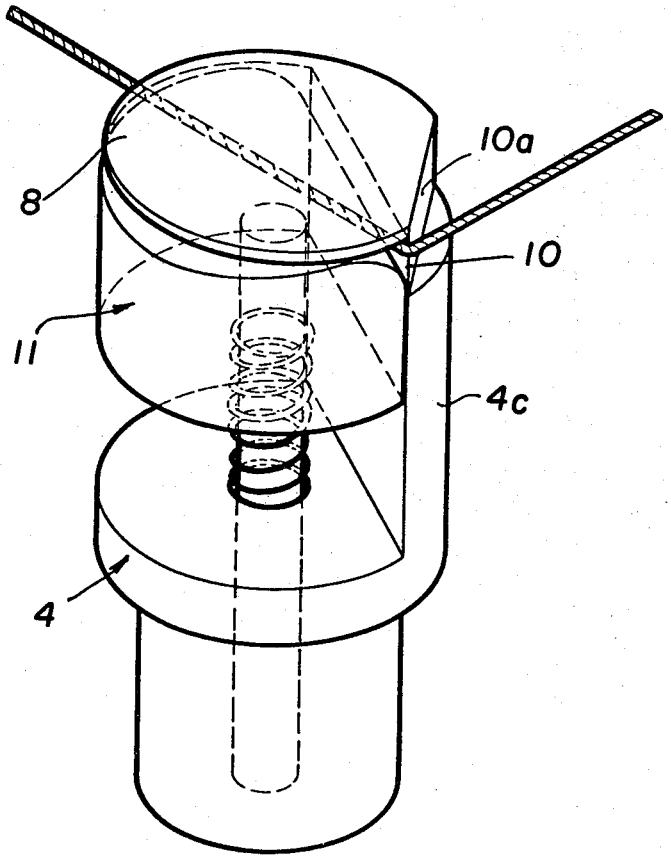
FIG. 9 is a perspective of an example according to FIGS. 3 to 5.

FIG. 9 is a perspective view of an example according to FIGS. 3 to 5 showing how the thread may enter between elements 8 and 11 and be cut at 10.

Figures 6, 7, 8:
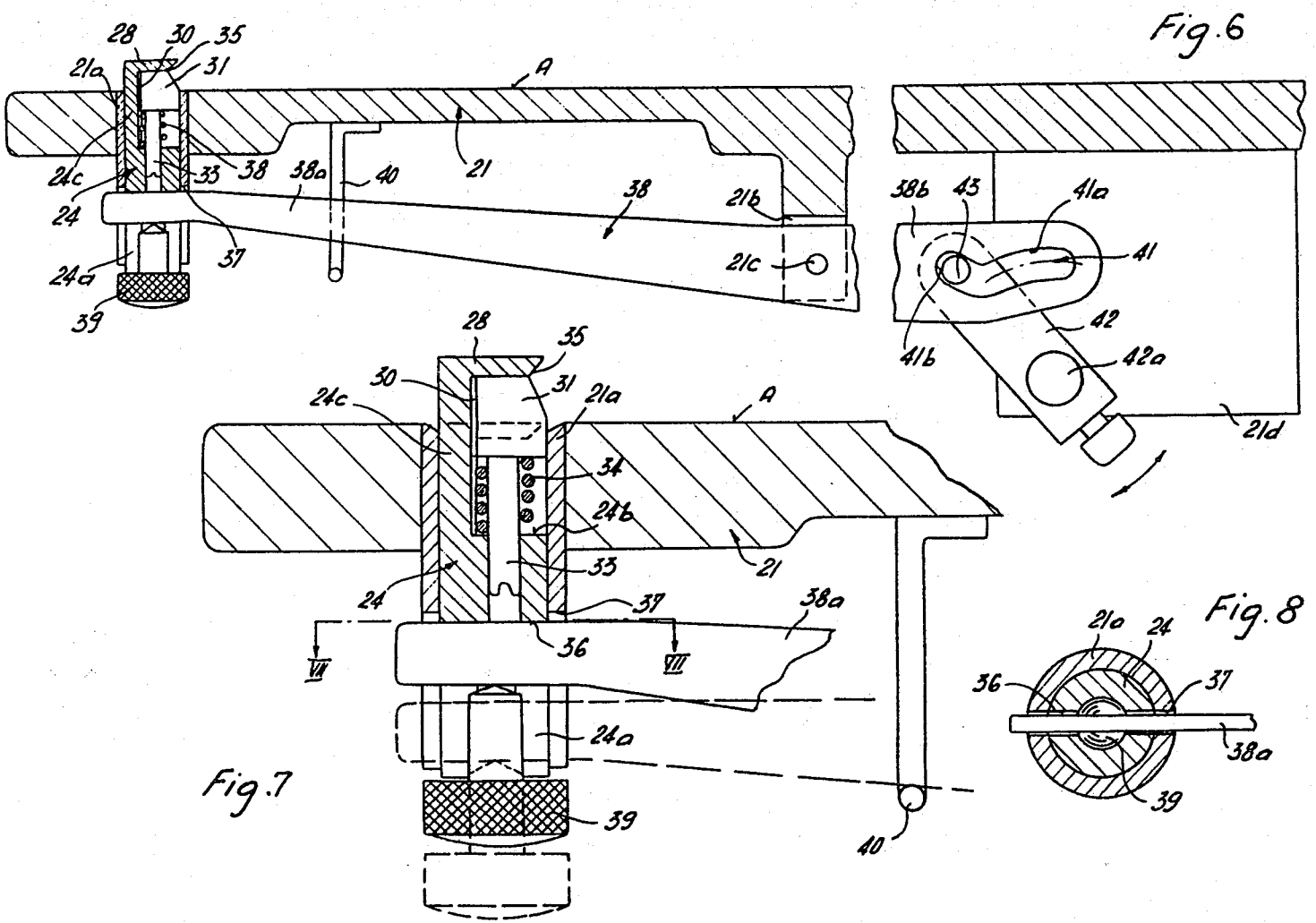
FIG. 6 shows, in a vertical section, partially broken away, one embodiment of the gripper and cutting device in a flat-bed sewing machine.
FIG. 7 shows, on an enlarged scale, a detailed portion of FIG. 6.
FIG. 8 shows a cross section taken along line VII—VII of FIG. 7.

In FIGS. 6 and 7 of the drawings, element 21 denotes the base plate of a flat-bed sewing machine, having a working surface A. A guide bushing 21*a* is firmly inserted in a bore of the base plate 21 at a spacing from the needle penetration point (not shown) corresponding to the first-described example. A retaining bush 24 of the gripper and cutting device is axially, displaceably arranged in the guide bushing 21*a*. Above an internally located shank portion 24*a* of the retaining bush 24, the latter is provided with a segment-shaped recess 24*b* extending over a peripheral angle of more than 180°, so that there remains an axially parallel marginal web 24*c* of an approximately crescent-shaped cross section (analogous to the embodiment of FIGS. 1–5) and, at the outer end of the retaining bush 24, a relatively thin-walled end portion 28. This end portion 28, slightly rounded on the inside along the free end rim, constitutes the fixed clamping disk of the device. The part of one axially parallel rim 30 of the marginal web 24*c*, originating from the end portion 28, is fashioned, for example, by an external bevel toward the cutting edge. In the segment-shaped recess 24*b* of the retaining bush 24, a second clamping disk 31 is arranged which is adapted to the cross section of this recess. The clamping disk 31 is firmly seated on a pin 33 guided in the shank portion 24*a* in a manner slightly offset with respect to the axis of the retaining bush. A helical spring 34 surrounding the pin 33 urges the inner clamping disk 31 against the external clamping disk 28 with a desired clamping pressure. The inner end portion of the shank part of the retaining bush 24 is equipped with a diametrical longitudinal slot 36. The guide bushing 21*a* is also provided, in the same plane, with a longitudinal slot 37 of approximately the same length. One arm 38*a* of a double lever 38 extends through these two longitudinal slots 36 and 37. This double lever is arranged to be pivotable on a pin 21*c* within limits, in a plane and at right angles to the working surface A at an internal projection 21*b* of the base plate 21. A cap screw 39 is threaded into a threaded bore of the shank portion 24*a*. This screw rests with its tip from below against the lever arm 38*a*, which in turn, projects upwardly with minimum play against the unslotted portion of the shank part 24*a*. The head of the screw 39 projects beyond the front edge of the guide bushing 21*a* and thus constitutes a safety means against the axial extraction of the retaining bush 24 in the outward direction from the guide bushing 21*a* even if the axial height of the slot 37 of the guide bushing 21*a* were to allow extraction of the retaining bush past a desirable extent. Exiting of the retaining bush 24 from the guide bushing 21*a* in the inward direction is made impossible thanks to a holding bracket 40 fixed to the base plate 21, this bracket extending under the lever arm 38. The holding bracket 40 limits the possible pivotal motion of the lever arm 38*a* in the downward direction in such a manner that, when the arm 38*a* rests on the holding bracket 24, which moves downwardly along with the arm 38*a*, assumes a position wherein the topside of the external clamping disk 28 lies in the plane of the working surface A. In contrast thereto, with the arm 38*a* being pivoted upwardly, the retaining bush 24 in the guide bushing 21*a* is pushed upwardly past the working surface A to such an extent that the gripping plane formed between the two clamping disks 28 and 31 is markedly above the working surface A, i.e. by several mm (under practical conditions about 4–7 mm). The upper limitation for this pivotal movement of the arm 38*a* is constituted by the slot base of the guide bushing 21*a*.

In the illustrated example, the other arm 38*b* of the double lever 38 is equipped with a cam route 41 wherein a pin 43 is guided. The pin 43 is affixed to a guide arm 42. The cam route 41 comprises a section 41*a* extending concentrically to the axis 42*a*, and a section 41*b* controlling the motion of the double lever 38. The guide arm 42 is pivotable within limits about an axle 42*a* in parallel to the pin 21*c* on an inner bracket 21*d* of the base plate 21. This guide arm 42 is operatively connected, in a manner not illustrated, with the lifting mechanism of the presser foot and/or its operating element, in such a way that when the presser foot is lifted (by operating the aforementioned element), the double lever 38 is pivoted, approximately in the last third of its lifting path, under the action of section 41*b* of the cam route 41, cooperating with the pin 43, into the illustrated position wherein the lever arm 38*a* shifts the retaining bush 24 toward the outside to such a degree that the clamping plane formed by the clamping disks 28 and 31 and thus the thread lead-in gap 35, lie in a predetermined distance above the working surface A, this distance being several millimeters. During such an interruption in the sewing operation, it is thus possible in a simple way to introduce the thread in between the clamping disks and cut it off. If subsequently the presser foot is lowered again, the thus likewise pivoted double lever 38 pushes the retaining bush 24 with the clamping disks into the guide bushing to such an extent that the topside of the clamping disk 28 is in alignment with the working surface A. This is shown in dashed lines in FIG. 7. This prevents any projection of the device past the working surface A during the sewing operation, which, though minor, would still be interfering. It is to be noted that the rising of the presser foot caused by the thickness of the sewing material cannot evoke a projecting of the gripper and cutting device, since such movement has no effect on the operating element for lifting the presser foot and for the simultaneous pivoting of the double lever 38. Even a more extensive raising of the presser foot during manipulation of a workpiece will not affect the gripper and cutting device since no movement is imparted to the double lever 38 as long as the pin 43 of the guide arm 42 moves in the section 41*a* of the cam. In the illustrated example, a pivotable double lever 38 is provided for the axial shifting of the retaining bush 24, the arm 38*a* of this lever penetrating the slotted shank portion of the guide bushing and the retaining bush. The lever arm 38*a*, however, could also be operatively connected with the retaining bush 24 in some other way. Also, instead of the pivotable double lever 38, some other entraining means could be provided for lifting and lowering the retaining bush.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thread gripper and cutting device for a sewing machine containing a cover plate provided with a working surface comprising, two resiliently cooperating clamping disks and a cutting means with a cutting blade arranged at an angle with respect to the clamping plane of said disks, a retaining bush disposed at a spacing from the needle penetration point in a recess of the working surface of the machine and being secured against rotation, the inner shank portion of the bush being integrally connected, via an axially parallel marginal web containing the cutting blade, with an end portion constituting the outer clamping disk and projecting, in the operative position, at least in part and, in the inoperative position, at most in part, beyond said working surface, and with an inner clamping disk axially, movably guided between the shank portion and the end portion along the marginal web, and spring means resting against the shank portion for urging the outwardly oriented clamping surface of the inner clamping disk against the inwardly oriented clamping surface of the first clamping disk constituted by the end portion.

2. The gripper and cutting device according to claim 1, wherein the outer surface lines of the marginal web constituting the corner edges lie, in horizontal projection, on the connecting line between the needle penetration point and the axis of the device, wherein the corner edge most removed from the penetration point is fashioned at least in part as a cutter blade.

3. The gripper and cutting device according to claim 2, wherein the said connecting line is one diagonal of a square imagined in the feeding direction of the sewing material, behind and to the left of the needle penetration point on the working surface.

4. The gripper and cutting device according to claim 2 wherein the clamping surfaces of the clamping disks which form the clamping plane are inclined in an upward slope at an acute angle, away from the marginal web, the line of slope of these surfaces lying approximately at a right angle to the said connecting line.

5. The gripper and cutting device according to claim 3 wherein the diagonal spacing of penetration point and axis of the device is about 5 cm.

6. The gripper and cutting device according to claim 1 wherein the thread lead-in gap formed by the rounding of the clamping disk rims lies at the highest point of the clamping plane, whereas that part of the edge, most removed from the penetration point of the marginal web having a crescent cross sectional shape, originating from the lowest point of the clamping surface of the outer clamping disk, lying approximately in the plane of the working surface, is fashioned as a cutting blade.

7. The gripper and cutting device according to claim 1 wherein the retaining bush is secured against rotation by means of a radial pin disposed in an axially parallel slot in an eye of the cover plate which latter constitutes the working surface, and is held, in its axial operating position, with the outer clamping disk projecting past the working surface, the retaining bush being downwardly movable, from this operating position, into the working surface against the bias of a spring.

8. The gripper and cutting device according to claim 1 wherein an entrainment means movable by an operating element engages the retaining bush axially displaceable in a guide bushing, said entrainment means being movable, from a first operative position wherein the outer clamping disk is in alignment with the working surface into a second operative position wherein the clamping plane created between the clamping disks lies at a predetermined spacing above the working surface.

9. The gripper and cutting device according to claim 8, wherein the entrainment means is a double lever, with one arm penetrating a slot means provided in the guide bushing and retaining bush, at the retaining bush, said double lever being pivotable within limits about an axis in parallel to the working surface.

10. The gripper and cutting device according to claim 9, wherein the lever arm which engages the retaining bush is held between the slot base of the retaining bush and a cap screw inserted in an axial threaded bore of the slotted shank portion of the retaining bush and extending with its cap over the end face of the guide bushing.

11. The gripper and cutting device according to claim 10 wherein a sliding pin of a guide arm engages a guide slot of the other arm of the double lever, said guide arm being pivotable about an axle disposed at an inner bracket of the base plate.

12. The gripper and cutting device according to claim 8 wherein the entrainment means is operatively connected with an operating element of the lifting and lowering mechanism of the presser foot in such a manner that the retaining bush and thus the clamping plane, during lifting of the presser foot, are lifted with a delay above the working surface, but are lowered, when the presser foot is dropped, with acceleration underneath the working surface.

* * * * *